US005592691A

United States Patent [19]

Ronald

[11] Patent Number: 5,592,691

[45] Date of Patent: Jan. 14, 1997

[54] MODULAR PANEL FOR FABRICATING CLOTHING AND ACCESSORIES

[75] Inventor: Glen Ronald, Edmonton, Canada

[73] Assignee: Vancouver, Canada

[21] Appl. No.: 292,002

[22] Filed: Aug. 19, 1994

[30] Foreign Application Priority Data

Aug. 20, 1993 [CA] Canada ..... 2104496

[51] Int. Cl.[6] ..... A41D 01/06; A41H 03/00

[52] U.S. Cl. ..... 2/69; 2/69.5; 2/89; 2/243.1

[58] Field of Search ..... 2/69, 69.5, 89, 2/243.1

[56] References Cited

U.S. PATENT DOCUMENTS

| | | | |
|---|---|---|---|
| 2,148,334 | 2/1939 | Freedman . | |
| 2,211,100 | 8/1940 | Cohen | 2/75 |
| 2,670,470 | 3/1954 | Manheim et al. | 2/70 |
| 4,006,495 | 2/1977 | Jones | 2/93 |
| 4,158,892 | 6/1979 | Gonzales | 2/69.5 |
| 4,347,629 | 9/1982 | Itoi | 2/69.5 X |
| 4,658,443 | 4/1987 | Berman | 2/105 |
| 5,331,685 | 7/1994 | Belgard | 2/69 X |
| 5,343,578 | 9/1994 | Kettenhofen | 2/69.5 X |

FOREIGN PATENT DOCUMENTS

| | | |
|---|---|---|
| 2626147 | 7/1989 | France . |

*Primary Examiner*—Daniel Zirker
*Attorney, Agent, or Firm*—Anthony R. Lambert

[57] ABSTRACT

A modular panel is described which has a flexible planar sheet form body with peripheral edges. Zippers are positioned along each of the four peripheral edges. The zippers along the peripheral edges of the body enable the peripheral edges to be mated with each other or other bodies to form articles of clothing, clothing accessories and the like.

3 Claims, 5 Drawing Sheets

MODULAR PANEL FOR FABRICATING CLOTHING AND ACCESSORIES

The present invention relates to a modular panel for fabricating clothing and accessories.

BACKGROUND OF THE INVENTION

The concept of "modular" clothing is known in the art having been taught in references such as French publication 2,626,147 filed by Diricq et al which was published in 1989. The Diricq reference discloses a tailoring system in which clothing is manufactured utilizing modular panels related to selected key dimensions of the human frame. The key dimensions Diricq selects are: the depth from waistband to crotch, the width of the bottom of the trouser leg, the circumference of the thigh, the height from the ground of the crotch, and the height from the ground of the knee.

Modular "panels" as taught by Diricq are not universal in application. In other words, one of the modular panels of Diricq intended for use in a pair of trousers cannot be used to fabricate a shirt or another item of clothing. In this sense the modular panels of Diricq cannot readily be used as building blocks to construct diverse items of clothing or accessories.

SUMMARY OF THE INVENTION

What is required is a modular panel which is more universal in application.

According to the present invention there is provided a modular panel including a flexible planar sheet form body with a plurality of peripheral edges. Reusable fastening means are positioned along each of the peripheral edges.

It is preferred that the modular panel be rectangular with four peripheral edges as this shape can be used to assemble the widest range of clothing. There are, however, a variety of other shapes that may be successfully used as will be hereinafter further described. The fastening means along the peripheral edges of the body enable the peripheral edges to be mated with each other or other bodies to form articles of clothing, clothing accessories and the like. The preferred form of fastening means consists of rows of interlocking tabs which are joined and separated by a sliding member which moves up or down the row; such fasteners being more commonly referred to as "zippers". There are, however, other types of reusable fasteners which may be successfully used.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
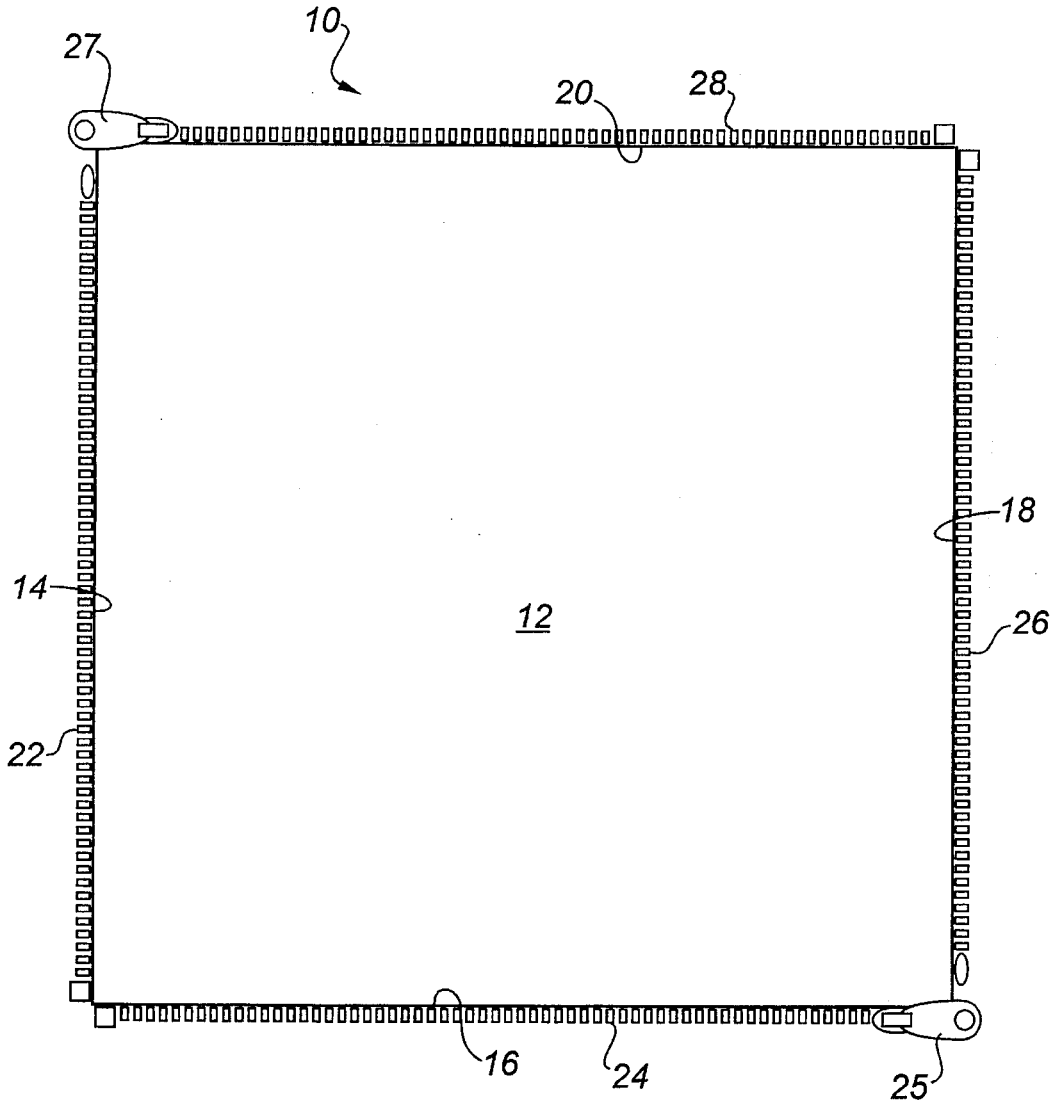
FIG. 1 is a modular panel constructed in accordance with the teachings of the present invention.

The preferred embodiment, a modular panel generally identified by reference numeral 10, will now be described with reference to FIGS. 1 through 6.

Referring to FIG. 1, modular panel 10 has a flexible planar sheet-form rectangular body 12 with four peripheral edges 14, 16, 18, and 20. A row of zipper tabs 22, 24, 26, and 28, are positioned along peripheral edges 14, 16, 18, and 20, respectively. Peripheral edge 16 has a sliding member 25 mounted on zipper tabs 24. Peripheral edge 20 has a sliding member 27 mounted on zipper tabs 28.

The use of modular panel 10 will now be described with reference to FIGS. 1 through 6. Zipper tabs 22, 24, 26, and 28 along peripheral edges 14, 16, 18, and 20, respectively, of body 12 enable peripheral edges 14, 16, 18, and 20 to be mated with each other or other bodies identical to body 12 to form articles of clothing, clothing accessories and the like. By operating their sliding members 25 and 27, zipper tabs 24 and 28, respectively, interlock with zipper tabs on an adjoining body 12.

Figure 2:
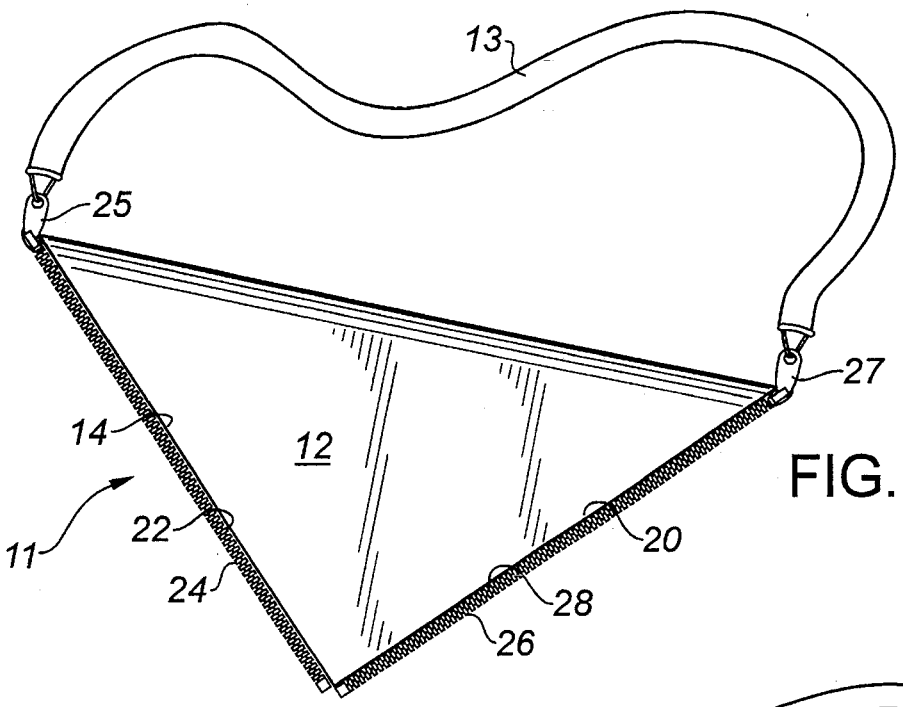
FIG. 2 is a hip bag constructed from one of the modular panels illustrated in FIG. 1.

Referring to FIG. 2, there is illustrated a hip bag, generally identified by reference numeral 11, constructed of one of modular panels 10. The construction of hip bag 11 as illustrated in FIG. 2, involves the following steps. Firstly, sliding member 25 is used to mate zipper tabs 22 with zipper tabs 24 to connect peripheral edge 14 with peripheral edge 16. Secondly, sliding member 27 is used to mate zipper tabs 26 with zipper tabs 28 to connect peripheral edge 18 with peripheral edge 20. A carrying strap 13 is then added to facilitate carrying of hip bag 11.

Figure 3:
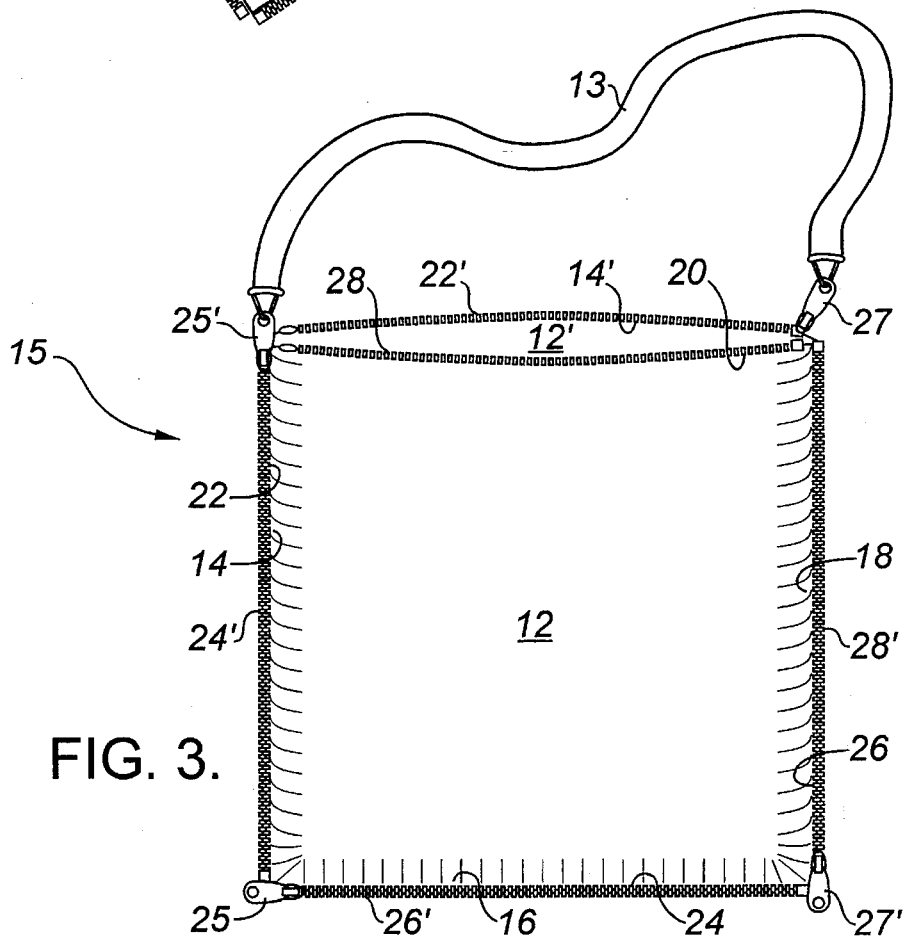
FIG. 3 is a purse constructed from a pair of the modular panels illustrated in FIG. 1.

Referring to FIG. 3, there is illustrated a purse, generally identified by reference numeral 15, constructed of two of modular panels 10. The construction of purse 15, as illustrated in FIG. 3, involves the following steps. In the description which follows components from the second of modular panels 10 will be designated as 12', 14', 16', etc. Firstly, sliding member 25' is used to mate zipper tabs 22 of body 12 with zipper tabs 24' of body 12' to connect peripheral edge 14 with peripheral edge 16'. Secondly, sliding member 25 is used to mate zipper tabs 24 of body 12 with zipper tabs 26' of body 12' to connect peripheral edge 16 with peripheral edge 18'. Thirdly, sliding member 27' is used to mate zipper tabs 26 of body 12 with zipper tabs 28' of body 12' to connect peripheral edge 18 with peripheral edge 20'. Peripheral edge 20 and peripheral edge 14' can either be left open, as illustrated, or sliding member 27 may be used to mate zipper tabs 28 of body 12 is mated with zipper tabs 22' of body 12' to connect peripheral edge 20 with peripheral edge 14'. A carrying strap 13 is then added to facilitate carrying of purse 15.

Figure 4:
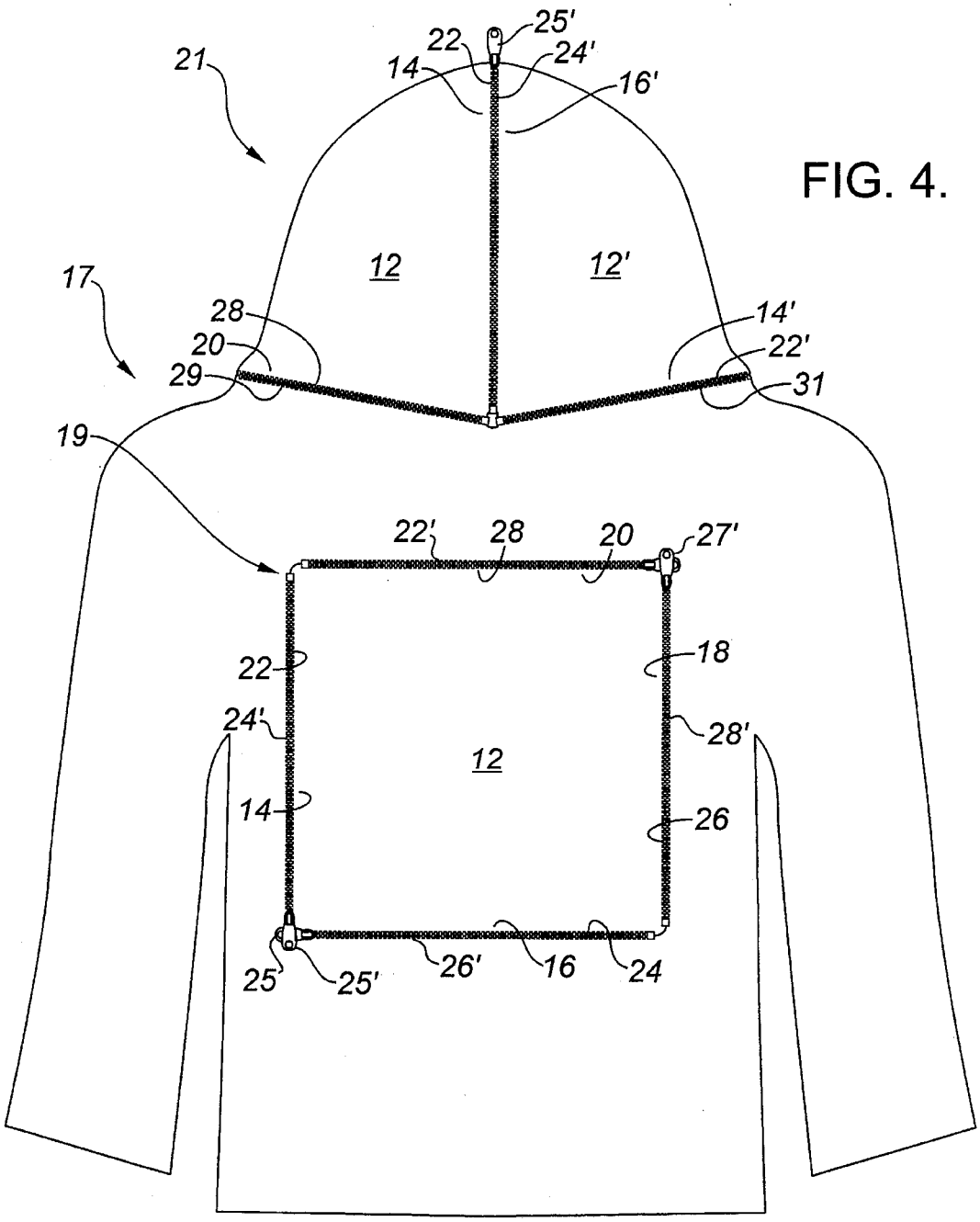
FIG. 4 is a garment into which has been incorporated a plurality of the modular panels illustrated in FIG. 1.

Referring to FIG. 4, there is illustrated a coat 17 which has incorporated into its design three of modular panels 10. A modular panel 10 is positioned on the back of coat 17. This modular panel preferably would be for purposes for ornamentation. For example, the logo from the wearer's favourite sports team would be emblazoned on modular panel 10. The wearer can switch from supporting his favourite football team, to a favourite basketball team, baseball team or hockey team merely by substituting modular panel 10 with another modular panel upon which a different logo is emblazoned. Coat must have a mounting area for modular panel 10 generally identified by reference numeral 19, which has four groups of zipper tabs 22', 24', 26', 28' in a rectangular configuration. The attachment of modular panel to the mounting area is identical to the manner in which handbag 15 is assembled, as described in relation to FIG. 3. Two of modular panels 10 are used as a hood 21. Hood 21 is constructed by using sliding member 25' to interlock zipper tabs 22 of body 12 with zipper tabs 24' of body 12' thereby connecting peripheral edge 14 with peripheral edge 16'. Although not shown in FIG. 4, sliding member 25 is used to interlock zipper tabs 24 of body 12 with zipper tabs 26' of body 12' to connect peripheral edge 16 with peripheral edge 18'. Peripheral edges 18 and 20' are left unattached and encircle the wearer's facial area. Referring to FIG. 4, coat 17 has two sets of zipper tabs 29 and 31 on which are mounted sliding members (not shown). The sliding members are used to mate zipper tabs 28 on peripheral edge 20 of body 12 with zipper tabs 29 and zipper tabs 22' on peripheral edge 14' of body 12' with zipper tabs 31.

Figure 5A:
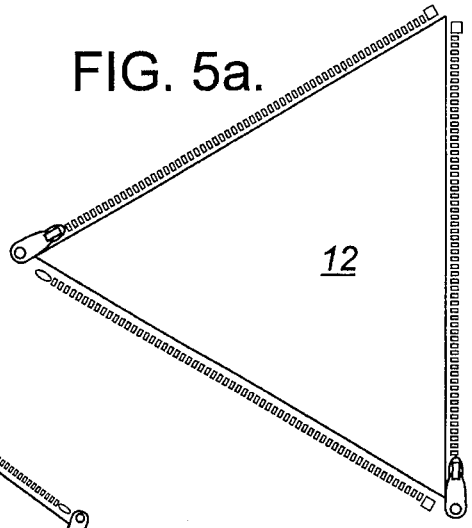
FIG. 5*a* through 5*c* show alternative shapes for the modular panel illustrated in FIG. 1.
Figure 5B:
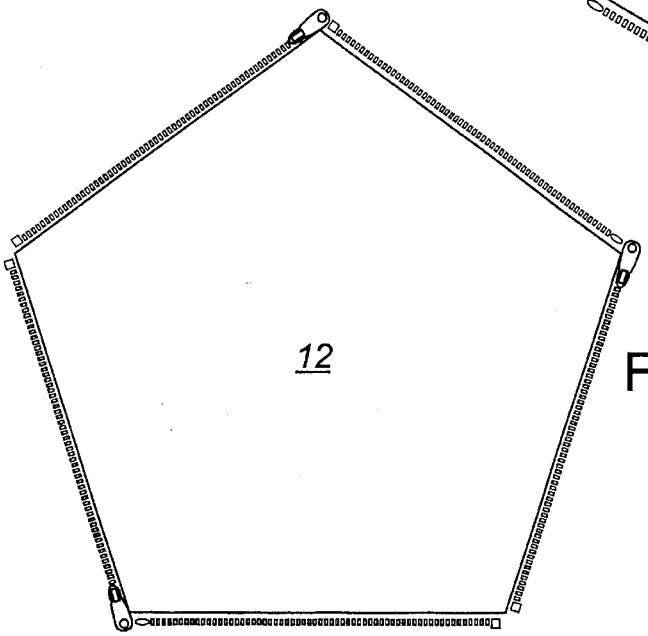
Figure 5C:
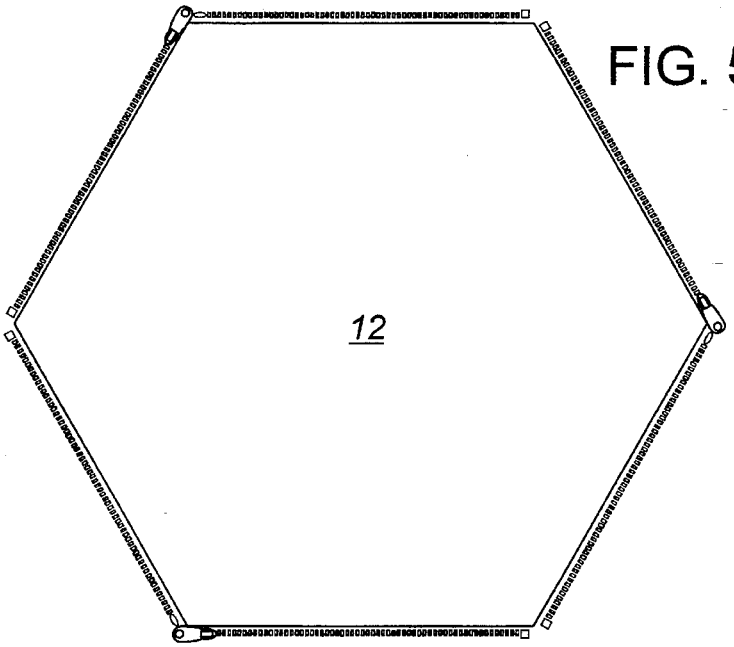

Referring to FIGS. 5*a* through 5*c*, there is illustrated some alternative shapes for body 12. Although all of the shapes illustrated can be successfully used, it is preferred that body 12 be rectangular with four peripheral edges as this configuration can most readily to formed into sleeves and leg portions. Shapes other than rectangular can prove useful in making the garment more closely follow the contours of the human body.

Figure 6:
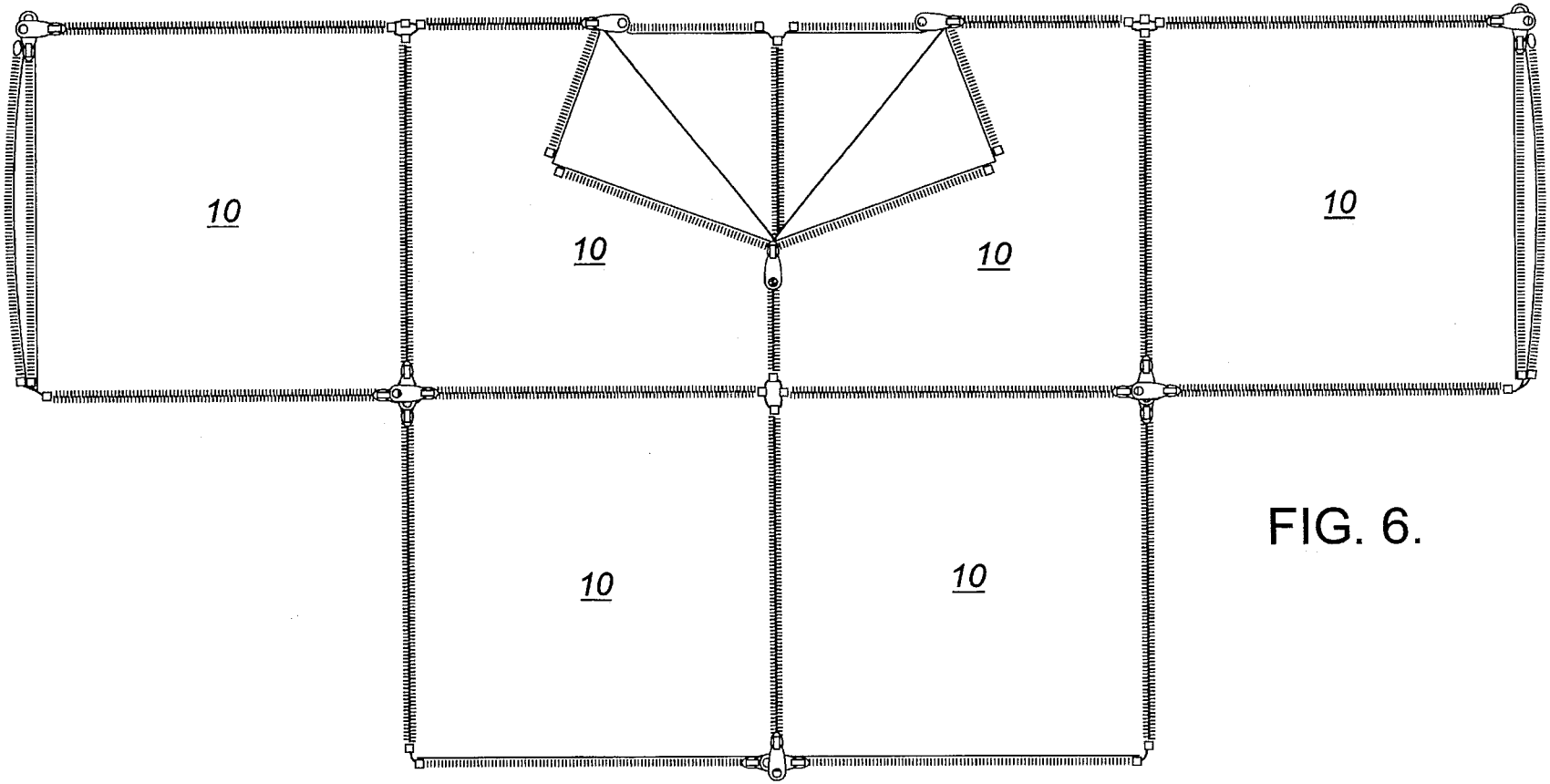
FIG. 6 is a garment constructed of plurality of the modular panels illustrated in FIG. 1.

Referring to FIG. 6, there is illustrated a coat that is made entirely of modular panels 10. Modular panels 10 interconnect in the manner previously described.

It will be apparent to one skilled in that art that the various articles of clothing and accessories are merely illustrative of potential uses for modular panel 10. The limits on the use of modular panels 10 are largely set by the limits of one's imagination. It will also be apparent to one skilled in the art that by using combinations of alternative shapes of body 12 as illustrated in FIGS. 5*a*, 5*b*, and 5*c* that the designs of garments can be varied. It will finally be apparent to one skilled in the art that modifications may be made to the illustrated embodiments without departing from the spirit and scope of the invention.

The embodiments of the invention in which an exclusive property or privilege is claimed are defined as follows:

1. A garment, comprising:

a plurality of modular panels, each modular panel including a flexible planar sheet form regular polygonal shaded body with at least three peripheral edges and reusable fastening means along each of the at least three peripheral edges, whereby the peripheral edges of the body are mated with another regular polygonal shaped body.

2. The garment as defined in claim 1, wherein the reusable fastening means are zippers, each of the at least three peripheral edges having a single row of zipper tabs with at least two of the peripheral edges having a sliding member mounted on the zipper tabs.

3. The garment as defined in claim 1, wherein all of the plurality of modular panels are identical.

* * * * *